US009897945B2

(12) United States Patent
Sakamoto et al.

(10) Patent No.: US 9,897,945 B2
(45) Date of Patent: Feb. 20, 2018

(54) INTERMEDIATE TRANSFERRER AND IMAGE FORMING APPARATUS

(71) Applicant: Konica Minolta, Inc., Tokyo (JP)

(72) Inventors: Sadaaki Sakamoto, Tokyo (JP); Takayuki Suzuki, Saitama (JP); Ito Koga, Tokyo (JP); Eiichi Yoshida, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/265,255

(22) Filed: Sep. 14, 2016

(65) Prior Publication Data

US 2017/0090353 A1 Mar. 30, 2017

(30) Foreign Application Priority Data

Sep. 28, 2015 (JP) ..... 2015-189469

(51) Int. Cl.
*G03G 15/16* (2006.01)

(52) U.S. Cl.
CPC ... *G03G 15/162* (2013.01); *G03G 2215/0135* (2013.01)

(58) Field of Classification Search
CPC ..... G03G 15/162
See application file for complete search history.

(56) References Cited

U.S. PATENT DOCUMENTS

2011/0020740 A1* 1/2011 Sugino ..... G03G 5/0525 430/56
2012/0230740 A1* 9/2012 Mikami ..... G03G 15/162 399/308

FOREIGN PATENT DOCUMENTS

| | | | |
|---|---|---|---|
| JP | S62-191079 | A | 8/1987 |
| JP | H04-019761 | A | 1/1992 |
| JP | H09-292767 | A | 11/1997 |
| JP | H10-010896 | A | 1/1998 |
| JP | 2009-275203 | A | 11/2009 |
| JP | 2010-085518 | A | 4/2010 |
| JP | 2014-149479 | A | 8/2014 |
| JP | 2015-148661 | A | 8/2015 |

OTHER PUBLICATIONS

Notice of Reasons for Rejection dated Oct. 24, 2017 from corresponding Japanese Patent Application No. JP 2015-189469 and English Translation.

* cited by examiner

*Primary Examiner* — Erika J Villaluna
(74) *Attorney, Agent, or Firm* — Lucas & Mercanti, LLP

(57) ABSTRACT

An intermediate transfer belt includes a base layer, an elastic layer, and a surface layer. The elastic layer is composed of an elastomer composition containing an elastomer and metal oxide particles. At least a portion of a surface of the metal oxide particles is positioned at a surface of the elastic layer. At least the portion is coupling-treated with a metal coupling agent. A radical polymerizable functional group of the metal coupling agent is bonded to a radical polymerizable compound composing the surface layer via radical polymerization.

10 Claims, 2 Drawing Sheets

INTERMEDIATE TRANSFERRER AND IMAGE FORMING APPARATUS

CROSS REFERENCE TO RELATED APPLICATIONS

This application is entitled to and claims the benefit of Japanese Patent Application No. 2015-189469, filed on Sep. 28, 2015, the disclosure of which including the specification, drawings and abstract is incorporated herein by reference in its entirety.

BACKGROUND OF THE INVENTION

1. Field of the Invention

The present invention relates to an intermediate transferrer and an image forming apparatus including the intermediate transferrer.

2. Description of Related Art

An image forming apparatus transfers a toner image formed on a photoreceptor to an intermediate transferrer, and then transfers the toner image to a recording medium such as plain paper. The intermediate transferrer is, for example, an endless intermediate transfer belt including an elastic layer for enhancing the contact property to the photoreceptor or the recording medium, and a surface layer for suppressing abrasion of the elastic layer. From the viewpoint of preventing the surface layer from being peeled off from the elastic layer due to stress during the transfer, the adhesive property between the elastic layer and the surface layer is preferably high. From the viewpoints of enhancing the adhesive property between the elastic layer and the surface layer, and the like, intermediate transferrers that employ a metal coupling agent has been known (e.g., Japanese Patent Application Laid-Open No. 10-10896, Japanese Patent Application Laid-Open No. 9-292767, and Japanese Patent Application Laid-Open No. 4-19761).

In the intermediate transferrer disclosed in Japanese Patent Application Laid-Open No. 10-10896, an inorganic filler treated with a silane coupling agent containing perfluoroalkyl groups is dispersed in a surface layer. Further, in the intermediate transferrer disclosed in Japanese Patent Application Laid-Open No. 9-292767, an intermediate layer composed of a silane coupling agent capable of reacting with an SiH group in an elastic layer is disposed between the elastic layer and a surface layer. Furthermore, in the intermediate transferrer disclosed in Japanese Patent Application Laid-Open No. 4-19761, the surface of an elastic layer is coated with a titanate-based coupling agent or an aluminum-based coupling agent to form a surface layer.

However, both in the intermediate transferrers disclosed in Japanese Patent Application Laid-Open No. 10-10896 and Japanese Patent Application Laid-Open No. 4-19761, the elastic layer and the surface layer are not adhered by chemical bonding, and thus the adhesive property between the elastic layer and the surface layer is not sufficient. Further, in the intermediate transferrer disclosed in Japanese Patent Application Laid-Open No. 9-292767, the elastic layer and the intermediate layer are adhered by chemical bonding via an SiH group in the elastic layer, but the intermediate layer and the surface layer are not adhered by chemical bonding. Consequently, also in the intermediate transferrer disclosed in Japanese Patent Application Laid-Open No. 9-292767, the adhesive property between the elastic layer and the surface layer is not sufficient.

Moreover, when an elastic layer is coupling-treated with a silane coupling agent, in general, a hydroxyl group is required to be present in a portion of the elastic layer, which serves as a surface to be treated, in order for the elastic layer and the silane coupling agent to be chemically bonded to each other. When a material that has no hydroxyl group constitutes a surface to be treated, performing a treatment for generating a hydroxyl group (e.g., corona treatment) on the surface to be treated may result in deterioration of the material constituting the elastic layer in some cases.

SUMMARY OF THE INVENTION

A first object of the present invention is to provide an intermediate transferrer that can be produced without deteriorating a material and is excellent in adhesive property between an elastic layer and a surface layer. Further, a second object of the present invention is to provide an image forming apparatus including the intermediate transferrer.

In order to achieve the first object, an intermediate transferrer that reflects an aspect of the present invention includes a base layer, an elastic layer disposed on the base layer and composed of an elastomer composition containing an elastomer and metal oxide particles, and a surface layer disposed on the elastic layer and formed by curing a radical polymerizable compound via radical polymerization, in which at least a portion of a surface of the metal oxide particles is positioned at a surface of the elastic layer, at least the portion is coupling-treated with a metal coupling agent having a radical polymerizable functional group, and the radical polymerizable functional group of the metal coupling agent is bonded to the radical polymerizable compound via radical polymerization.

In order to achieve the second object, an image forming apparatus that reflects an aspect of the present invention has at least the intermediate transferrer of the present invention for transferring a toner image formed on a photoreceptor to a recording medium.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

[Intermediate Transferrer]

Figure 1A:
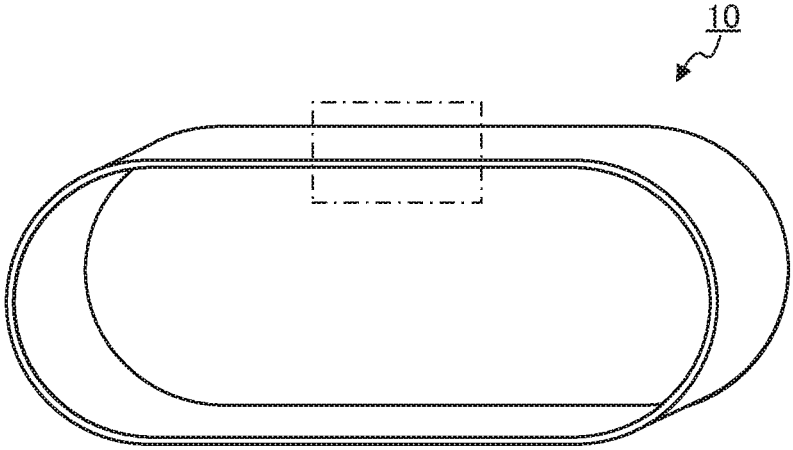
FIG. 1A schematically illustrates an intermediate transfer belt according to an embodiment of the present invention, and FIG. 1B schematically illustrates a layer structure of the intermediate transfer belt illustrated in FIG. 1A.
Figure 1B:
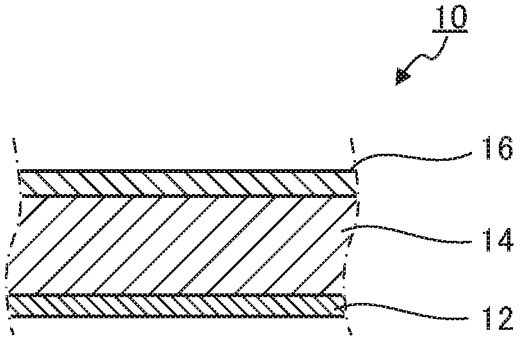

As an embodiment of the intermediate transferrer according to the present invention, an intermediate transfer belt will be described in detail with reference to the drawings. FIG. 1A schematically illustrates intermediate transfer belt 10 according to the present embodiment. FIG. 1B is a partially enlarged cross-sectional view of an area indicated by an alternate long and short dash line in FIG. 1A, schematically illustrating a layer structure of intermediate transfer belt 10.

Intermediate transfer belt 10 is an endless belt, as illustrated in FIG. 1A. Further, as illustrated in FIG. 1B, intermediate transfer belt 10 includes base layer 12, elastic layer 14 disposed on base layer 12 and composed of an elastomer composition, and surface layer 16 disposed on elastic layer 14 and formed by curing a radical polymerizable compound via radical polymerization.

Base layer 12 is an endless belt having intended conductivity and flexibility. Base layer 12 is composed of a flexible resin, for example, and supports elastic layer 14. From the viewpoints of enhancing mechanical strength and durability, it is preferable that intermediate transfer belt 10 includes base layer 12. From the viewpoint of exhibiting the intended function of base layer 12, the thickness of base layer 12 is preferably 50 to 100 μm, and is 70 μm, for example. The thickness of base layer 12 can be determined, for example, as measurement values obtained from the cross-section at the time when cutting intermediate transfer belt 10 in a layered direction or as an average value thereof.

Examples of the resin composing base layer 12 include polyimide (PI), polyamide (PA), polyamideimide (PAI), polyetheretherketone (PEEK), polyvinylidene fluoride (PVDF), polycarbonate (PC), polyphenylene sulfide (PPS), polymethyl methacrylate (PMMA), polystyrene (PS), polyacrylonitrile-styrene copolymer, polyvinyl chloride (PVC), acetate, acrylonitrile-butadiene-styrene (ABS), and polyester (PE). From the viewpoints of enhancing the mechanical strength and durability of base layer 12, the resin composing base layer 12 is preferably polyimide (PI), polyamideimide (PAI), polyphenylene sulfide (PPS), or polyetheretherketone (PEEK).

Base layer 12 may be a cylindrical sleeve having conductivity. Use of the cylindrical sleeve for base layer 12 forms an intermediate transfer drum. The intermediate transfer drum is included in the embodiment of the intermediate transferrer according to the present invention.

Elastic layer 14 disposed on the outer circumferential surface of base layer 12 is a layer having intended conductivity and elasticity. Elastic layer 14 is composed of an elastomer composition, and the elastomer composition contains an elastomer and metal oxide particles. From the viewpoint of exhibiting the intended function of elastic layer 14, the thickness of elastic layer 14 is preferably 50 to 500 μm, and is 200 μm, for example. The thickness of elastic layer 14 can be determined, for example, as measurement values obtained from the cross-section at the time when cutting intermediate transfer belt 10 in a layered direction or as an average value thereof.

The elastomer has no hydroxyl group. As used herein, the phrase "has no hydroxyl group" means that the elastomer substantially has no hydroxyl group, which means, for example, that there is no hydroxyl group in a part or all of structural units of the elastomer. The elastomer may contain a hydroxyl group unless the amount of the hydroxyl group contributes to the enhancement of the adhesive property between elastic layer 14 and surface layer 16 brought by chemical bonding via a metal coupling agent.

Examples of the elastomer include chloroprene rubber (CR), nitrile butadiene rubber (NBR), epichlorohydrin rubber (ECO), and urethane rubber (U). From the viewpoints of: having sufficient durability to the environment in the image forming apparatus (ozone resistance, or the like); having sufficient mechanical strength when provided for image formation; and properly controlling electric resistance of intermediate transfer belt 10, the material for the elastomer is preferably chloroprene rubber or nitrile butadiene rubber.

At least a portion of a surface of the metal oxide particles is positioned at the surface of elastic layer 14. The portion either may be positioned only at the surface of elastic layer 14, or may be positioned not only at the surface of elastic layer 14 but also inside elastic layer 14, as long as at least a portion is positioned at the surface of elastic layer 14. The method for disposing at least the portion of the surface of the metal oxide particles at the surface of elastic layer 14 is not particularly limited. For example, the metal oxide particles can be compounded into elastic layer 14 such that the content of the metal oxide particles in elastic layer 14 is 20 parts by mass or more relative to 100 parts by mass of the elastomer. Infrared spectroscopic analysis can be used to confirm that the metal oxide particles are positioned at the surface of elastic layer 14.

Further, at least the portion of the surface of the metal oxide particles is coupling-treated with a metal coupling agent having a radical polymerizable functional group. Either the entire surface of the metal oxide particles may be coupling-treated, or only the portion of the surface of the metal oxide particles which is positioned at the surface of elastic layer 14 may be coupling-treated, as long as at least the portion of the surface of the metal oxide particles which is positioned at the surface of elastic layer 14 is coupling-treated. While the detail thereof will be described later, it is preferable that only the portion of the surface of the metal oxide particles which is positioned at the surface of elastic layer 14 is coupling-treated with a metal coupling agent. In intermediate transfer belt 10 according to the present embodiment, only the portion of the surface of the metal oxide particles which is exposed at the surface of elastic layer 14 is coupling-treated with a metal coupling agent. In general, metal oxide particles are covered with hydroxyl groups which are surface functional groups. The metal oxide particles that are coupling-treated are bonded to metal atoms of the metal coupling agent via the hydroxyl groups. That is, the metal oxide particles and the metal coupling agent are bonded to each other via oxygen-metal bond.

Element analysis by means of X-ray photoelectron spectroscopy (ESCA) may be used to confirm that the surface of the metal oxide particles is coupling-treated. Further, by etching the surface of elastic layer 14 with an electron ray to scrape elastic layer 14 for conducting elemental analysis, it becomes possible to confirm the state of the coupling treatment of metal oxide particles also in the depth direction of elastic layer 14. This makes it possible to confirm whether only the portion of the surface of the metal oxide particles which is positioned at the surface of elastic layer 14 is coupling-treated, or the entire surface thereof is coupling-treated.

Examples of metal oxides composing the metal oxide particles in elastic layer 14 include aluminum oxide, aluminum hydroxide, magnesium oxide, magnesium hydroxide, zinc oxide, tin oxide, titanium oxide, silicon dioxide, potassium titanate, barium titanate, lead zirconate titanate (PZT), iron oxide, beryllium oxide, antimony oxide, and calcium oxide. The metal oxide particle may be a mineral composed of one or two or more of the metal oxides. Examples of the mineral include talc, wollastonite, xonotlite, mica, zeolite, and hydrotalcite.

The metal oxides composing the metal oxide particles in elastic layer 14 may be appropriately selected, from the viewpoint of further imparting a desired function to intermediate transfer belt 10. For example, the metal oxide is preferably aluminum hydroxide, antimony oxide, magnesium hydroxide, or hydrotalcite, from the viewpoint of imparting flame retardancy. The metal oxide is preferably silicon dioxide, titanium oxide, talc, mica, wollastonite, potassium titanate, and xonotlite.

The metal oxide is preferably silicon dioxide from the viewpoint of adjusting the volume resistivity of elastic layer 14. The metal oxide is preferably magnesium oxide from the viewpoint of using the metal oxide particles also as an acid scavenger. The metal oxide is preferably zinc oxide or tin oxide from the viewpoint of using the metal oxide particles also as a crosslinking promoter in forming elastic layer 14. The metal oxide is preferably talc or silicon dioxide from the viewpoint of using the metal oxide particles also as an extender.

The metal oxide is preferably silver ion-carrying zeolite from the viewpoint of using the metal oxide particles also as an antibacterial agent. The metal oxide is preferably magnetic iron oxide from the viewpoint of imparting magnetic properties. The metal oxide is preferably alumina or beryllium oxide from the viewpoint of imparting thermal conductivity. The metal oxide is preferably barium titanate or lead zirconate titanate (PZT) from the viewpoint of imparting piezoelectricity. The metal oxide is preferably mica or xonotlite from the viewpoint of imparting vibration-damping property.

The metal oxide is preferably talc from the viewpoint of imparting slidability. The metal oxide is preferably lead zirconate titanate (PZT) from the viewpoint of imparting electromagnetic wave-absorbing property. The metal oxide is preferably magnesium oxide, hydrotalcite, or aluminum oxide from the viewpoint of using the metal oxide particles also as a heat ray radiation agent. The metal oxide is preferably titanium oxide, zinc oxide, or iron oxide from the viewpoint of imparting UV resistance.

The metal oxide is preferably calcium oxide or magnesium oxide from the viewpoint of using the metal oxide particles also as a moisture absorbent or a dehydrating agent. The metal oxide is preferably zeolite or activated clay from the viewpoint of using the metal oxide particles also as a deodorant or a gas absorbent.

The metal oxide is preferably silicon dioxide or talc from the viewpoint of using the metal oxide particles also as an anti-blocking agent. The metal oxide is preferably Cladophora ball-like xonotlite from the viewpoint of using the metal oxide particles also as an oil absorbent. The metal oxide is preferably calcium oxide or magnesium oxide from the viewpoint of using the metal oxide particles also as a water absorbent.

The metal oxide particles in elastic layer 14 may be used singly or in combination.

The shape of the metal oxide particles in elastic layer 14 is not particularly limited. The particle diameter of the metal oxide particles in elastic layer 14 may be appropriately changed from the viewpoint of exhibiting desired characteristics. In general, as the particle diameter of the metal oxide particles becomes smaller, the exhibition of the characteristics of the metal oxide particles tends to be more conspicuous. On the other hand, when the particle diameter of the metal oxide particles is too small, it becomes difficult to have better handling properties thereof including dispersibility in some cases. In general, as the particle diameter of the metal oxide particles becomes larger, it tends to be easier to handle the metal oxide particles. On the other hand, when the particle diameter of the metal oxide particles is too large, the surface roughness of elastic layer 14 is undesirably increased in some cases. From the above viewpoints, the particle diameter of the metal oxide particles is preferably 10 nm to 100 μm, and more preferably 100 nm to 10 μm. This particle diameter can be a representative value specifying the size of the metal oxide particles, and is, for example, a volume average particle diameter or a number average particle diameter. Further, this particle diameter either may be a measurement value or a catalogue value.

The content of the metal oxide particles in elastic layer 14 is not particularly limited, and may be appropriately changed depending on the particle diameter of the metal oxide particles, or the like. Further, while the detail thereof will be described later, it is preferable that the content of the metal oxide particles in elastic layer 14 is 30 parts by mass or more relative to 100 parts by mass of the elastomer.

The hardness of an elastomer composition as measured using a type A micro rubber durometer MD-1 is preferably 60 to 80°. When the hardness of the elastomer composition is too low, there is a fear of insufficient durability of intermediate transfer belt 10. Further, when the hardness of the elastomer composition is too high, there is a fear of occurrence of defective transfer in an image forming apparatus including intermediate transfer belt 10 according to the present embodiment, resulting in incapability of forming a high-quality image. The hardness of the elastomer composition can be adjusted, for example, by the compounding amount of the metal oxide particles having the function of adjusting the hardness to the elastomer. It is noted that MD-1 durometer (manufactured by Kobunshi Keiki Co., Ltd.) is a type A durometer in accordance with JIS K6253 (ISO 7619).

In the image forming apparatus including intermediate transfer belt 10 according to the present embodiment, the volume resistivity of the elastomer composition is preferably $1\times10^{8}$ to $1\times10^{11}$ Ω·cm from the viewpoints of suppressing the occurrence of defective transfer and of forming a high-quality image. The volume resistivity of the elastomer composition can be adjusted, for example, by the compounding amount of the metal oxide particles having the function of adjusting the volume resistivity to the elastomer. The volume resistivity is a value measured in accordance with JIS K6911 (ISO 2951).

The elastomer composition preferably has a flame retardancy of VTM-2 or higher in a flame retardancy test in UL 94 standard. This is because, when the flame retardancy of the elastomer composition fails to satisfy VTM-2, there is fear of not being able to withstand practical use because the elastomer composition is below the standard. The flame retardancy of the elastomer composition can be adjusted by the compounding amount of the metal oxide particles having the function of imparting the flame retardancy to the elastomer. It is noted that the criteria for determination is VTM-0, VTM-1, and VTM-2 in the descending order of flame retardancy.

The metal coupling agent contains a radical polymerizable functional group. The radical polymerizable functional group of the metal coupling agent is bonded to a radical polymerizable compound composing surface layer 16 to be described later via radical polymerization. The type of the radical polymerizable functional group is not particularly limited as long as it can be bonded to the radical polymerizable compound via radical polymerization. Examples of the radical polymerizable functional group include a vinyl group, a styryl group, and a (meth)acryloyl group. The type of the metal coupling agent is not particularly limited as long as it can perform the above-described functions. Examples of the metal coupling agent include a silane coupling agent, a titanate coupling agent, and an aluminum coupling agent. The metal coupling agent may be used singly or in combination. As used herein, the term "(meth)acryloyl group" means one or both of an acryloyl group and a methacryloyl group.

Examples of the silane coupling agent include vinyltrialkoxysilanes such as vinyltrimethoxysilane and vinyltriethoxysilane; p-styryltrialkoxysilanes such as p-styryltrimethoxysilane; 3-methacryloxypropyltrialkoxysilanes such as 3-methacryloxypropyldimethoxysilane, 3-methacryloxypropyltrimethoxysilane, 3-methacryloxypropylmethyldiethoxysilane, and 3-methacryloxypropyltriethoxysilane; and 3-acryloxytrialkoxysilanes such as 3-acryloxypropyltrimethoxysilane.

Examples of the titanate coupling agent include isopropyltriisostearoyl titanate, isopropyltridodecylbenzenesulfonyl titanate, isopropyltris(dioctylpyrophosphate) titanate, tetraisopropylbis(dioctylphosphite) titanate, tetraoctylbis(ditridecylphosphite) titanate, tetra(2,2-diallyloxymethyl-1-butyl)bis(di-tridecyl)phosphite titanate, bis(dioctylpyrophosphate)oxyacetate titanate, bis(dioctylpyrophosphate) ethylene titanate, isopropyltrioctanoyl titanate, isopropyldimethacrylisostearoyl titanate, isopropyltris(dioctylphosphate) titanate, isopropyltricumylphenyl titanate, isopropyltri(N-aminoethyl.aminoethyl) titanate, dicumylphenyloxyacetate titanate, and diisostearoylethylene titanate.

Examples of the aluminum coupling agent include acetoalkoxyaluminum diisopropylate, and monobutoxyaluminum diisopropylate.

Both base layer 12 and elastic layer 14 may further contain a conductive agent in order to exhibit an intended conductivity. As the conductive agent, a known material for imparting conductivity to a resin material of intermediate transfer belt 10 is used. The conductive agent may be used singly or in combination. Examples of the conductive agent include an ion conductive agent and an electron conductive agent. Examples of the ion conductive agent include silver iodide, copper iodide, lithium perchlorate, lithium trifluoromethanesulfonate, lithium salts of organoboron complexes, lithium bisimide $(CF_3SO_2)_2NLi$) and lithium trismethide $(CF_3SO_2)_3CLi$). Examples of the electron conductive agent include metals such as silver, copper, aluminum, magnesium, nickel, and stainless steel; and carbon compounds such as graphite, carbon black, carbon nanofibers, and carbon nanotubes. The total content of the conductive agent in base layer 12 and elastic layer 14 is an amount that realizes an intended volume resistivity of intermediate transfer belt 10. The intended volume resistivity of intermediate transfer belt 10 is $1\times10^8$ to $1\times10^{11}$ Ω·cm, for example.

Surface layer 16 disposed on the outer circumferential surface of elastic layer 14 is a layer formed by curing a radical polymerizable compound via radical polymerization. Surface layer 16 has both moderate softness capable of protecting elastic layer 14 and being deformed in accordance with deformation of elastic layer 14 and sufficient durability (such as mechanical strength and releasability) to the contact with a photoreceptor and a recording medium. Further, a radical polymerizable functional group of the metal coupling agent is bonded to a radical polymerizable compound composing surface layer 16 via radical polymerization. It can be deduced, for example, from the results of the analysis of surface layer 16 by pyrolysis GC-MS, that the radical polymerizable functional group is bonded to the radical polymerizable compound composing surface layer 16 via radical polymerization.

Examples of the radical polymerizable compound for composing the surface layer 16 include bifunctional monomers such as bis(2-acryloxyethyl)-hydroxyethyl-isocyanurate, 1,6-hexanediol diacrylate, 1,4-butanediol diacrylate, 1,9-nonanediol diacrylate, neopentylglycol diacrylate and hydroxypivalate neopentylglycol diacrylate, and urethane acrylate; trimethylolpropane triacrylate (TMPTA), pentaerythritol triacrylate, tris(acryloxyethyl)isocyanurate, ditrimethylolpropane tetraacrylate, pentaerythritol tetraacrylate (PETTA), dipentaerythritol hexaacrylate (DPHA), and urethane acrylate. The radical polymerizable compound may be used singly or in combination. The radical polymerizable compound composing surface layer 16 can be deduced, for example, from the results of the analysis of surface layer 16 by pyrolysis GC-MS.

Further, from the viewpoints of bringing both the above-mentioned softness and durability to surface layer 16, the thickness of surface layer 16 is preferably 1.0 to 7.0 μm, and more preferably 1.5 to 5.0 μm. The thickness of surface layer 16 can be determined, for example, as measurement values obtained from the cross-section at the time when cutting intermediate transfer belt 10 in a layered direction or as an average value thereof.

Surface layer 16 may further contain other components as long as intended characteristics (e.g., softness, durability, and adhesive property mentioned above) are obtained. Examples of such other components include metal oxide particles. It is preferable that metal oxide particles are contained in surface layer 16, from the viewpoints of the metal oxide particles in surface layer 16 preventing abrasion of surface layer 16, and of reinforcing surface layer 16. The content of the metal oxide particles in surface layer 16 is preferably 10 to 100 parts by volume relative to 100 parts by volume of a portion of surface layer 16 other than the metal oxide particles, from the viewpoint of enhancing the mechanical strength of surface layer 16.

The shape of the metal oxide particles in surface layer 16 is not particularly limited. The particle diameter of the metal oxide particles in surface layer 16 is preferably 1 to 100 nm. This particle diameter can be a representative value specifying the size of the metal oxide particles, and is, for example, a volume average particle diameter or a number average particle diameter. Further, this particle diameter either may be a measurement value or a catalogue value. Examples of the metal oxide particles in surface layer 16 include alumina, tin oxide, and titania. More preferable example is alumina.

In addition, examples of the above-mentioned other components include vinyl acetate, styrene, acrylonitrile, and vinyl copolymers such as siloxane-vinyl copolymer. It is particularly preferable that this siloxane-vinyl copolymer contains at least one polyorganosiloxane chain A and three or more radical polymerizable double bonds, from the viewpoints of preventing filming in intermediate transfer belt 10, and of maintaining low surface free energy of surface layer 16. Further, the weight average molecular weight of the siloxane-vinyl copolymer is preferably 5,000 to 100,000, form the viewpoint of enhancing the compatibility of the siloxane-vinyl copolymer in a coating liquid for forming a surface layer to be described later.

Furthermore, when using the siloxane-vinyl copolymer and the metal oxide particles in surface layer 16 in combination, it is preferable that the metal oxide particles in surface layer 16 is surface-treated with a silicone surface treating agent, from the viewpoint of dispersing both the metal oxide particles and a siloxane structure derived from the siloxane-vinyl copolymer in surface layer 16. This is because the siloxane structure dispersed in surface layer 16 can exhibit stable releasability brought by the siloxane structure over a long period of time.

Examples of the silicon surface treating agent include methyl hydrogen polysiloxane and modified silicone oil. Examples of the modified silicone oil include amino-modified silicone, epoxy-modified silicone, carbinol-modified silicone, mercapto-modified silicone, and carboxyl-modified silicone. From the viewpoints of exhibiting the intended function and of easy handleability at the time of surface treatment, the weight average molecular weight of the silicon surface treating agent is 300 to 20,000, for example.

[Process for Producing Intermediate Transferrer]

The process for producing intermediate transfer belt 10 is not particularly limited. Intermediate transfer belt 10 according to the present embodiment can be produced by a first production process or a second production process.

(First Production Process)

The first production process for intermediate transfer belt 10 includes the steps of: 1) applying onto base layer 12 first coating liquid A1 for forming an elastic layer containing an elastomer and metal oxide particles whose surfaces are coupling-treated with a metal coupling agent having a radical polymerizable functional group to form first liquid film A2 of first coating liquid A1 on base layer 12; 2) drying and curing first liquid film A2 to form elastic layer 14; 3) applying onto elastic layer 14 second coating liquid A2 for forming a surface layer containing a radical polymerizable compound while at least the portion of the surface of the metal oxide particles is positioned at the surface of elastic layer 14, to form second liquid film B2 of second coating liquid A2 on elastic layer 14; and 4) drying second liquid film B2 for allowing the radical polymerizable functional group and the radical polymerizable compound to undergo radical polymerization to form surface layer 16.

It is noted that base layer 12 can be formed by known methods. Examples of the step of forming base layer 12 include a step of heating a liquid film of polyamic acid applied on the surface of a cylindrical substrate for imidizing the polyamic acid, to collect a resultant endless belt-like film as a base layer, as disclosed in Japanese Patent Application Laid-Open No. 61-95361, Japanese Patent Application Laid-Open No. 64-22514, and Japanese Patent Application Laid-Open No. 3-180309.

First, elastic layer 14 is formed. Specifically, first, first coating liquid A1 for forming an elastic layer containing an elastomer and metal oxide particles is prepared. In the first production process, the metal oxide particles have been coupling-treated with a metal coupling agent. The metal oxide particles having been coupling-treated either may be those that have been coupling-treated in advance, or may be those that have been purchased as ready-made products. The method of the coupling treatment of metal oxide particles can utilize a coupling treatment liquid similar to that for the coupling treatment to be described later. Then, first coating liquid A1 is applied onto base layer 12 to form first liquid film B1 of first coating liquid A1 on base layer 12. Thereafter, first liquid film B1 is dried and cured to be able to form elastic layer 14.

For example, first coating liquid A1 can be prepared by dissolving and dispersing a kneaded mixture of the elastomer and the metal oxide particles in a known solvent. Examples of the known solvent to be used for first coating liquid A1 include toluene. Further, first coating liquid A1 may also contain other components such as a conductive agent.

The metal oxide particles are preferably contained in first coating liquid A1 at 20 parts by mass or more relative to 100 parts by mass of the elastomer after curing. This allows at least the portion of the surface of the metal oxide particles to be disposed at the surface of elastic layer 14 when elastic layer 14 is formed. While the detail thereof will be described later, it is preferable that the metal oxide particles are contained in first coating liquid A1 at 30 parts by mass or more relative to 100 parts by mass of the elastomer after curing.

The method of applying first coating liquid A1 may be appropriately selected from known coating methods depending on the composition of first coating liquid A1. Examples of the method of applying first coating liquid A1 include a dip coating method and a spiral coating method.

The method of drying first liquid film B1 may be appropriately selected depending on the types of solvents, the thickness of elastic layer 14, or the like. Examples of the method of drying first liquid film B1 include natural drying and heat drying using a known heating apparatus such as a halogen heater, an infrared heater, or a hot air heater.

Lastly, surface layer 16 is formed. Specifically, first, second coating liquid A2 for forming a surface layer containing a radical polymerizable compound is prepared. Then, second coating liquid A2 is applied onto elastic layer 14 to form second liquid film B2 of second coating liquid A2 on elastic layer 14. Thereafter, second liquid film B2 is dried and irradiated with actinic energy radiation for allowing the radical polymerizable functional group of the metal coupling agent and the radical polymerizable compound in second liquid film B2 to undergo radical polymerization to be able to form surface layer 16.

For example, second coating liquid A2 can be prepared by dissolving the radical polymerizable compound in a known solvent. Examples of the known solvent to be used for second coating liquid A2 include propylene glycol monomethyl ether acetate (PMA). Further, second coating liquid A2 may also contain other components such as a polymerization initiator (to be described later), a surface tension regulator, and a conductive agent.

Second coating liquid A2 may further contain a polymerization initiator from the viewpoint of facilitating curing via radical polymerization. The polymerization initiator may be used singly or in combination. The polymerization initiator is selected depending on the method of curing second liquid film B2. For example, when second liquid film B2 is cured by the irradiation with actinic energy radiation, a photopolymerization initiator is used as the polymerization initiator.

Examples of the photopolymerization initiator include carbonyl compounds such as 1-hydroxycyclohexyl phenyl ketone, benzoin, henzoin methyl ether, benzoin ethyl ether, benzoin isopropyl ether, benzoin isobutyl ether, acetoin, butyroin, toluoin, benzil, benzophenone, p-methoxybenzophenone, dietboxyacetophenone, 2,2-dimethoxy-2-phenylacetophenone, methyl phenylglyoxylate, ethyl phenylglyoxylate, 4,4-bis(dimethylaminobenzophenone), 2-hydroxy-2-methyl-1-phenylpropan-1-one, and 1-(4-isopropylphenyl)-2-hydroxy-2-methylpropan-1-one; sulfur compounds such as tetramethylthiuram disulfide and tetramethylthiuram disulfide; azo compounds such as azobisisobutyronitrile and azobis-2,4-dimethyl valeronitrile; peroxide compounds such as benzoyl peroxide, di tert-butyl peroxide; and phosphineoxide compounds such as 2,4,6-trimethylbenzoyldiphenylphosphineoxide.

The content of the photopolymerization initiator in second coating liquid A2 is preferably 0.1 to 20 mass %, and is more preferably 1 to 10 mass %, relative to the total amount of resin solid content, for example. As used herein, the term "resin solid content" refers to a component present as a resin in second liquid film B2 (surface layer 16) after curing, and examples thereof include a resin to be added in the second coating liquid A2 and the radical polymerizable compound polymerized in the step of radical polymerization.

The method of applying second coating liquid A2 may be appropriately selected from known coating methods depending on the composition of second coating liquid A2. Examples of the method of applying second coating liquid A2 include a dip coating method and a spiral coating method.

The method of drying second liquid film B2 may be appropriately selected depending on the types of solvents, the thickness of surface layer 16, or the like. Examples of the method of drying second liquid film B2 include natural drying and heat drying using a known heating apparatus such as a halogen heater, an infrared heater, or a hot air heater.

The radical polymerization can be performed according to known methods such as heating and irradiation with actinic energy radiation. For example, as for the irradiation with actinic energy radiation, the radiation quantity is preferably 100 mJ/cm$^2$ or more, more preferably 120 to 200 mJ/cm$^2$, and still more preferably 150 to 180 mJ/cm$^2$, from the viewpoints of preventing curing unevenness in second liquid film B2, and of optimizing hardness after curing, curing time and curing speed. The radiation quantity can be measured using UIT250 (manufactured by Ushio Inc.), for example. The irradiation of second liquid film B2 with actinic energy radiation can be performed using an irradiation apparatus having an irradiation source of actinic energy.

Examples of the actinic energy radiation include UV rays, electron rays, and γ-rays. Preferable examples of the actinic energy radiation include UV rays and electron rays, and more preferable examples thereof include UV rays from the viewpoint of easiness to handle, for example. Examples of the irradiation source of the UV rays include a low-pressure mercury lamp, a medium-pressure mercury lamp, a high-pressure mercury lamp, an ultrahigh-pressure mercury lamp, a carbon-arc lamp, a metal halide lamp, a xenon lamp, an ArF excimer laser, a KrF excimer laser, an excimer lamp, and an apparatus for generating a synchrotron radiation. The UV rays are UV rays having a wavelength of 400 nm or less, for example.

Examples of the irradiation source of the electron rays include electron ray accelerators of various types such as Cockcroft-Walton type, Van de Graaf type, resonance transformation type, insulated core transformer type, linear type, Dynamitron type and radio-frequency type. Examples of the electron rays include electron rays having energy of 50 to 1,000 keV, and preferably 100 to 300 keV.

The time of irradiation with actinic energy radiation is appropriately determined from the viewpoints of curing efficiency of second liquid film B2 and operation efficiency. The irradiation time is preferably 0.5 seconds to 5 minutes, and more preferably 3 seconds to 2 minutes.

The oxygen concentration in the atmosphere during the irradiation of the actinic energy radiation is preferably 5 volume % or less, and more preferably 1 volume % or less, from the viewpoint of preventing oxidization of formed surface layer 16. The oxygen concentration is adjusted by supplying other gases such as a nitrogen gas into the atmosphere. The oxygen concentration can be measured by OX100 oximeter for monitoring ambient gases (manufactured by Yokogawa Electric Corporation).

The second liquid film B2 can also be cured by heating using a known heating apparatus such as a halogen heater, an infrared heater, or a hot air heater. The temperature inside a heating chamber for housing the second liquid film B2 therein for heating is 140 to 160° C., for example.

(Second Production Process)

The second production process for intermediate transfer belt 10 includes the steps of: 1) applying onto base layer 12 first coating liquid A1' for forming an elastic layer containing an elastomer and metal oxide particles to form first liquid film Br of first coating liquid A1' on base layer 12; 2) drying and curing first liquid film Br to form elastic layer 14; 3) applying onto elastic layer 14 a coupling treatment liquid containing a radical polymerizable functional group while at least the portion of the surface of the metal oxide particles is positioned at the surface of elastic layer 14, to form a third liquid film of the coupling treatment liquid on elastic layer 14; 4) drying the third liquid film to allow only the portion of the surface of the metal oxide particles which is positioned at the surface of elastic layer 14 to be coupling-treated with the metal coupling agent; 5) applying onto elastic layer 14 second coating liquid A2 for forming a surface layer containing a radical polymerizable compound to form second liquid film B2 of second coating liquid A2 on elastic layer 14; and 6) drying second liquid film B2 for allowing the radical polymerizable functional group and the polymerizable compound to undergo radical polymerization to form surface layer 16.

The second production process for intermediate transfer belt 10 is similar to the first production process except that metal oxide particles not having been coupling-treated are used in the step of forming elastic layer 14, and that a coupling treatment of the metal oxide particles is performed after the formation of elastic layer 14, and thus the descriptions of the step of forming elastic layer 14 and of the step of forming surface layer 16 will be omitted.

In the second production process, elastic layer 14 is formed on base layer 12 similarly to the first production process. In the second production process, first coating liquid A1' for forming an elastic layer containing an elastomer and metal oxide particles not having been coupling-treated is prepared. Then, first coating liquid A1' is applied onto base layer 12 to form first liquid film Br of first coating liquid A1' on base layer 12. Thereafter, first liquid film Br is dried and cured to be able to form elastic layer 14.

Next, only the portion of the surface of the metal oxide particles which is positioned at the surface of elastic layer 14 is coupling-treated with a metal coupling agent having a radical polymerizable functional group. Specifically, first, a coupling treatment liquid for the coupling treatment is prepared. Then, the coupling treatment liquid is applied onto elastic layer 14. More specifically, the coupling treatment liquid is applied to the metal oxide particles positioned at the surface of elastic layer 14 while at least the portion of the surface of the metal oxide particles is positioned at the surface of elastic layer 14. Lastly, the third liquid film is dried, whereby only the portion of the surface of the metal oxide particles which is positioned at the surface of elastic layer 14 can be coupling-treated with the metal coupling agent having a radical polymerizable functional group.

For example, the coupling treatment liquid may be prepared by dissolving a metal coupling agent having a radical polymerizable functional group in a known solvent. Examples of the known solvent to be used for the coupling treatment liquid include water. The pH of the coupling treatment liquid is preferably adjusted to 3.5 to 4.5 using an acid such as acetic acid, from the viewpoint of enhancing solubility of the metal coupling agent in water.

The method of applying the coupling treatment liquid may be appropriately selected from known application methods depending on the composition of the coupling treatment liquid. Examples of the method of applying the coupling treatment liquid include application using a brush, dipping, and spraying.

The method of drying the third liquid film may be appropriately selected depending on the types of solvents, the thickness of elastic layer 14, or the like. Examples of the method of drying the third liquid film include natural drying and heat drying using a known heating apparatus such as a halogen heater, an infrared heater, or a hot air heater.

Lastly, surface layer 16 is formed on coupling-treated elastic layer 14, similarly to the first production process.

In accordance with the above-described production processes, intermediate transfer belt 10 according to the present embodiment can be produced. In both the first and second production processes, there is no need to separately carry out a step for generating a hydroxyl group (e.g., corona treatment) on a portion, which serves as a surface to be treated, of elastic layer 14 in the coupling treatment. Therefore, it is possible to produce intermediate transfer belt 10 according to the present embodiment by a simple method, without deteriorating an elastomer composing elastic layer 14.

In the first production process, the metal oxide particles have been coupling-treated in advance, and thus a coupling treatment does not need to be performed between the step of forming elastic layer 14 and the step of forming surface layer 16, which therefore enables intermediate transfer belt 10 to be produced easily. In addition, it is also possible to enhance the dispersibility of the metal oxide particles in the elastomer, because of the coupling treatment of the metal oxide particles.

In the second production process, only the portion of the surface of the metal oxide particles which is positioned at the surface of elastic layer 14 is coupling-treated after the formation of elastic layer 14. Therefore, it is possible to prevent a metal coupling agent from leaving the metal oxide particles in the steps of producing an elastomer composition containing an elastomer and the metal oxide particles (e.g., kneading step, dispersing step, and the like). In addition, it is also possible to prevent the change in physical properties (e.g., change in tensile strength, hardness, electric resistance, and the like) of elastic layer 14 caused by containing the metal coupling agent. Further, since only the portion of the surface of the metal oxide particles which contributes to the bonding to the metal coupling agent can be coupling-treated, and thus the amount of necessary metal coupling agent can be reduced, which is cost effective as well.

In intermediate transfer belt 10 according to the present embodiment, at least a portion of a surface of metal oxide particles is positioned at the surface of elastic layer 14. At least the portion has been coupling-treated with a metal coupling agent having a radical polymerizable functional group. Since a hydroxyl group is present on the surface of the metal oxide particles, the metal oxide particles in elastic layer 14 are bonded to metal atoms of the metal coupling agent via the hydroxyl group because of the coupling treatment. Further, the radical polymerizable functional group of the metal coupling agent is bonded to the radical polymerizable compound composing surface layer 16 via radical polymerization. Therefore, in intermediate transfer belt 10 according to the present embodiment, elastic layer 14 and surface layer 16 are firmly bonded together by chemical bonding via the metal coupling agent. As a result, the adhesive property between elastic layer 14 and surface layer 16 becomes high.

Furthermore, the enhancement of the adhesive property between elastic layer 14 and surface layer 16 via metal coupling is not affected by the types of metal oxide particles. Therefore, the types of metal oxide particles may be appropriately selected depending on intended characteristics (e.g., hardness, flame retardancy, antioxidation, volume resistivity, and the like) required of intermediate transfer belt 10.

As described above, intermediate transfer belt 10 according to the present embodiment has durability brought by high adhesive property between elastic layer 14 and surface layer 16, and thus can be suitably used for an intermediate transferrer in an image forming apparatus.

[Image Forming Apparatus]

An image forming apparatus according to the present invention includes at least an intermediate transferrer for transferring a toner image formed on a photoreceptor to a recording medium. The image forming apparatus according to the present invention can be configured similarly to known image forming apparatuses including an intermediate transferrer, except that it includes the intermediate transferrer according to the present invention. The image forming apparatus according to the present invention includes, for example: a photoconductor; a charging device that charges the photoconductor; an exposing device that irradiates the charged photoconductor with light and forms an electrostatic latent image; a developing device that supplies toner to the photoconductor having the electrostatic latent image formed thereon, and forms a toner image in accordance with the electrostatic latent image; a transfer device including an intermediate transferrer that transfers the toner image formed in accordance with the electrostatic latent image, to a recording medium; and a fixing device that fixes the toner image onto the recording medium. The "toner image" refers to a state where the toner gathers together in the form of an image.

Figure 2:
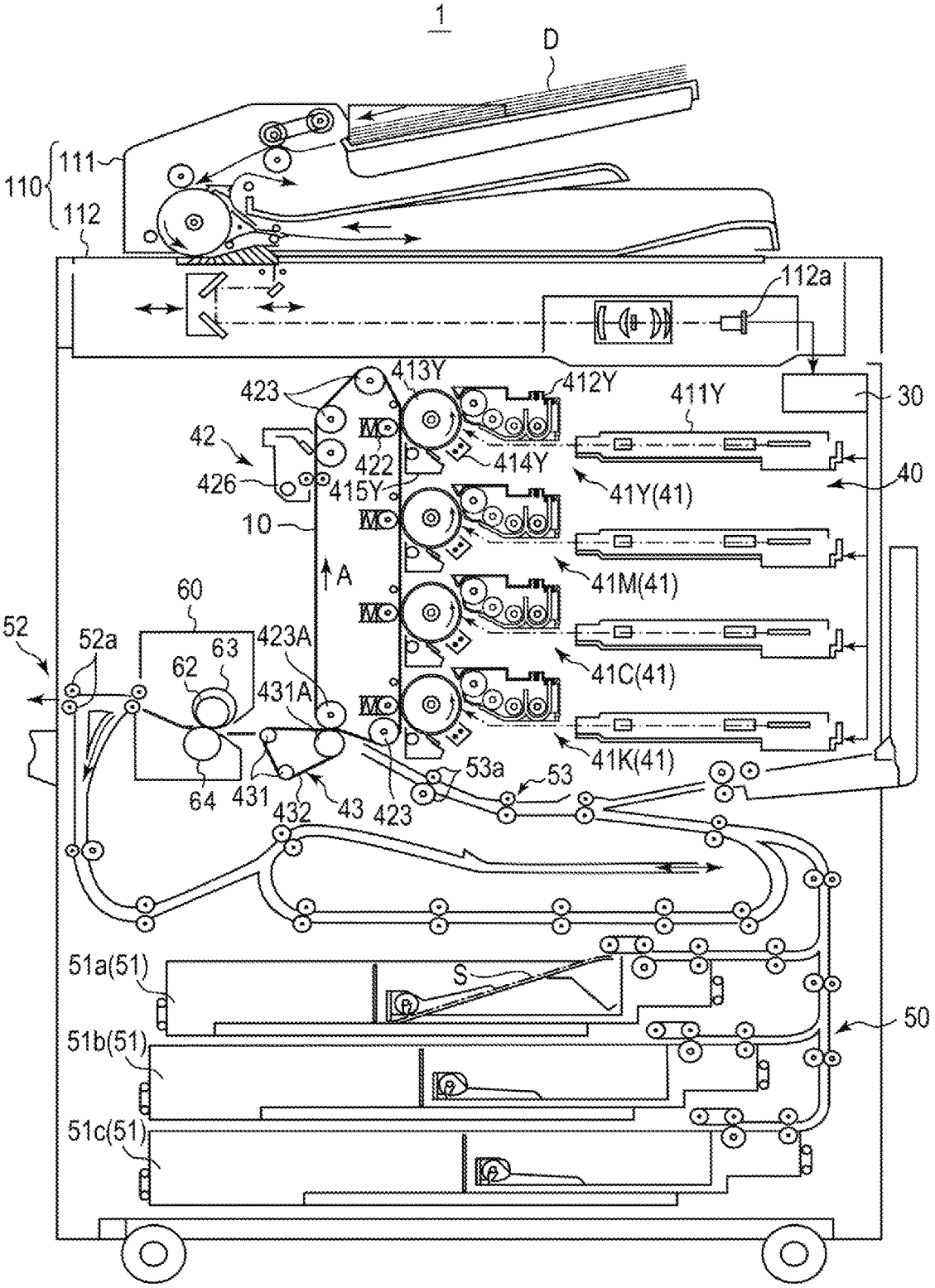
FIG. 2 schematically illustrates a configuration of an image forming apparatus according to an embodiment of the present invention.

FIG. 2 schematically illustrates the configuration of an image forming apparatus according to an embodiment of the present invention. As illustrated in FIG. 2, image forming apparatus 1 includes image reading section 110, image processing section 30, image forming section 40, sheet conveying section 50, and fixing device 60.

Image forming section 40 includes image forming units 41Y, 41M, 41C, and 41K that respectively form images using toners of four colors of yellow (Y), magenta (M), cyan (C), and black (K). Image forming units 41Y, 41M, 41C, and 41K have the same configuration except for the toner housed therein, and hence the symbol representing each color may be omitted hereinafter. Image forming section 40 further includes intermediate transfer unit 42 and secondary transfer unit 43. Intermediate transfer unit 42 and secondary transfer unit 43 correspond to the transfer device.

Image forming unit 41 includes exposing device 411, developing device 412, photoconductor drum 413, charging device 414, and drum cleaning device 415. Photoconductor drum 413 is, for example, a negative charge type organic photoconductor. The surface of photoconductor drum 413 has a photoconductive property. Photoconductor drum 413 corresponds to the photoconductor. Charging device 414 is, for example, a corona charger.

Charging device 414 may be a contact charging device that brings a contact charging member such as a charging roller, a charging brush, or a charging blade into contact with photoconductor drum 413 to thereby charge photoconductor drum 413. Exposing device 411 includes, for example, a semiconductor laser. Developing device 412 is, for example, a developing device adopting a two-component developing method.

Intermediate transfer unit 42 includes the above-mentioned intermediate transfer belt 10, primary transfer rollers 422 that each press intermediate transfer belt 10 against corresponding photoconductor drum 413, a plurality of support rollers 423 including backup roller 423A, and belt cleaning device 426. Intermediate transfer belt 10 is provided on the plurality of support rollers 423 in a loop-like tensioned state. At least one driving roller of the plurality of support rollers 423 rotates, whereby intermediate transfer belt 10 runs at a constant speed in an arrow A direction.

Secondary transfer unit 43 includes endless secondary transfer belt 432 and a plurality of support rollers 431 including secondary transfer roller 431A. Secondary transfer belt 432 is provided on secondary transfer roller 431A and support rollers 431 in a loop-like tensioned state.

Fixing device 60 includes: fixing roller 62; endless heat-generating belt 63 that covers the outer circumferential surface of fixing roller 62 and heats and fuses toner forming a toner image on sheet S; and pressure roller 64 that presses sheet S against fixing roller 62 and heat-generating belt 63. Sheet S corresponds to the recording medium.

Image forming apparatus 1 further includes image reading section 110, image processing section 30, and sheet conveying section 50. Image reading section 110 includes sheet feeder 111 and scanner 112. Sheet conveying section 50 includes sheet feeding section 51, sheet discharging section 52, and conveyance path section 53. Three sheet feed tray units 51*a* to 51*c* forming sheet feeding section 51 house therein, for each preset type, sheets S (standard sheets, special sheets) that are discriminated on the basis of the basis weight, the size, and the like. Conveyance path section 53 includes a plurality of paired conveyance rollers such as paired registration rollers 53*a*.

Hereinafter, formation of an image by image forming apparatus 1 will be described.

Scanner 112 optically scans and reads original D on its contact glass. Light reflected from original D is read by CCD sensor 112*a* to thereby provide input image data. The input image data is subjected to predetermined image processing by image processing section 30, and is then sent to exposing device 411.

Photoconductor drum 413 rotates at a constant circumferential speed. Charging device 414 uniformly negatively charges the surface of photoconductor drum 413. Exposing device 411 irradiates photoconductor drum 413 with laser light corresponding to the input image data of each color component. As a result, an electrostatic latent image is formed on the surface of photoconductor drum 413. Developing device 412 attaches toner onto the surface of photoconductor drum 413, whereby the electrostatic latent image is visualized. As a result, a toner image according to the electrostatic latent image is formed on the surface of photoconductor drum 413.

The toner image on the surface of photoconductor drum 413 is transferred to intermediate transfer belt 10 by intermediate transfer unit 42. The residual toner that remains on the surface of photoconductor drum 413 after the transfer is removed by drum cleaning device 415 including a drum cleaning blade in sliding contact with the surface of photoconductor drum 413.

Intermediate transfer belt 10 is pressed against photoconductor drum 413 by primary transfer roller 422, whereby a primary transfer nip is formed for each photoconductor drum by photoconductor drum 413 and intermediate transfer belt 10. At the primary transfer nip, toner images of the respective colors are transferred sequentially in a superimposed manner on intermediate transfer belt 10.

On the other hand, secondary transfer roller 431A is pressed against backup roller 423A with intermediate transfer belt 10 and secondary transfer belt 432 interposed therebetween. Thus, a secondary transfer nip is formed by intermediate transfer belt 10 and secondary transfer belt 432. Sheet S passes through the secondary transfer nip. Sheet S is conveyed to the secondary transfer nip by sheet conveying section 50. Inclination correction and conveyance timing adjustment of sheet S are performed by a registration roller section including paired registration rollers 53*a* placed therein.

When sheet S is conveyed to the secondary transfer nip, a transfer bias is applied to secondary transfer roller 431A. Through the application of the transfer bias, the toner image carried on intermediate transfer belt 10 is transferred to sheet S. Sheet S to which the toner image has been transferred is conveyed toward fixing device 60 by secondary transfer belt 432.

Fixing device 60 uses heat-generating belt 63 and pressure roller 64 to form a fixing nip, and heats and pressurizes sheet S conveyed thereto at the fixing nip portion. As a result, the toner image is fixed onto sheet S. Sheet S onto which the toner image has been fixed is discharged out of the image forming apparatus by sheet discharging section 52 including sheet discharging roller 52*a*.

It is noted that the residual toner that remains on the surface of intermediate transfer belt 10 after the secondary transfer is removed by belt cleaning device 426 having a belt cleaning blade in sliding contact with the surface of intermediate transfer belt 10.

When intermediate transfer belt 10 is pressed against photoconductor drum 413, surface layer 16 of intermediate transfer belt 10 is deformed in the same manner as the above-described elastic layer 14 is deformed due to its elasticity, and is brought into close contact with the surface of photoconductor drum 413. Thus, intermediate transfer belt 10 is brought into close contact with photoconductor drum 413. Also when intermediate transfer belt 10 is pressed against sheet S pressed by backup roller 423A, the surface of intermediate transfer belt 10 is brought into close contact with sheet S similarly. Thus, intermediate transfer belt 10 is excellent in the contact property to photoconductor drum 413 and sheet S.

Further, as described above, in intermediate transfer belt 10 according to the present embodiment, elastic layer 14 and surface layer 16 are firmly bonded together by chemical bonding via the metal coupling agent. Accordingly, even when a stress is applied to intermediate transfer belt 10 in association with the above-mentioned pressing, it is possible to prevent surface layer 16 from being peeled off from elastic layer 14. Therefore, image forming apparatus 1 is capable of suppressing defective transfer, and of stably forming a high-quality image over a long period of time.

As is obvious from the above description, an intermediate transferrer according to the present embodiment includes a base layer, an elastic layer disposed on the base layer and composed of an elastomer composition containing an elastomer and metal oxide particles, and a surface layer disposed on the elastic layer and formed by curing a radical polymerizable compound via radical polymerization, in which at least a portion of a surface of the metal oxide particles is positioned at a surface of the elastic layer, at least the portion has been coupling-treated with a metal coupling agent having a radical polymerizable functional group, and the radical polymerizable functional group of the metal coupling agent is bonded to the radical polymerizable compound via radical polymerization. Therefore, it is possible to provide an intermediate transfer belt that can be produced without deteriorating a material and is excellent in the adhesive property between an elastic layer and a surface layer. In addition, no hydroxyl group derived from an elastomer is required, and thus an elastomer having no hydroxyl group can be used.

Consequently, an image forming apparatus including the intermediate transfer belt is capable of suppressing defective transfer, and of stably forming a high-quality image over a long period of time.

The coupling treatment of only the portion of the surface of the metal oxide particles which is positioned at the surface of the elastic layer with the metal coupling agent is still more effective from the viewpoints of preventing the metal coupling agent from leaving in the steps of compounding metal oxide particles into an elastomer (e.g., kneading step, dispersing step, and the like), and of preventing the change in physical properties (e.g., change in tensile strength, hardness, electric resistance, and the like) of an elastic layer caused by dispersion of a metal coupling agent.

The content of the metal oxide particles in the elastic layer being 30 parts by mass or more relative to 100 parts by mass of the elastomer is still more effective from the viewpoint of further enhancing the adhesive property between the elastic layer and the surface layer.

The metal coupling agent being a silane coupling agent is still more effective from the viewpoint of versatility.

The radical polymerizable functional group being at least one member selected from the group consisting of a vinyl group, a styryl group, and a (meth)acryloyl group is still more effective from the viewpoints of reactivity and mechanical strength.

The hardness of the elastomer composition as measured using a type A micro rubber durometer MD-1 being 60 to 80° is still more effective from the viewpoints of enhancing the durability of an intermediate transferrer, of suppressing the occurrence of defective transfer in an image forming apparatus, and of forming a high-quality image.

The volume resistivity of the elastomer composition being $1\times10^{8}$ to $1\times10^{11}$ Ω·cm is still more effective from the viewpoints of suppressing the occurrence of defective transfer and of forming a high-quality image.

The elastomer composition having a flame retardancy of VTM-2 or higher in a flame retardancy test in UL 94 standard is still more effective from the viewpoint of withstanding practical use.

EXAMPLES

[Production of Intermediate Transferrer 1]

(Provision of Resin Substrate)

Carbon black (SPECIAL BLACK 4; manufactured by Degussa AG) as a conductive agent was added to polyamide imide varnish (HR-16NN; Toyobo Co., Ltd.) mainly composed of a precursor of polyamide imide such that the content of the carbon black was 19 parts by mass relative to 100 parts by mass of a resin component, and was mixed using a mixer to thereby prepare a coating liquid for forming a base layer.

Next, a cylindrical stainless mold having an outer diameter of 300 mm and a length of 550 mm was rotated at 50 rpm about a cylindrical axis, and a dispense nozzle was moved in the cylindrical axis direction, while a coating liquid for forming a base layer was discharged to the mold. Thus, a liquid film of the coating liquid for forming a base layer was formed on an outer circumferential surface of the mold. Then, the mold having the liquid film of the coating liquid for forming a base layer being formed on the outer circumferential surface thereof was rotated at 50 rpm about the cylindrical axis, while being heated at 100° C. for 1 hour using a far-infrared drying apparatus to thereby volatilize most of a solvent. Lastly, the mold was introduced into a heating furnace, and heated at 250° C. for 1 hour to thereby form an endless belt-like base layer having a thickness of 65 μm, which was employed as "resin substrate."

(Formation of Elastic Layer)

The following components in the following amounts were dissolved and dispersed in toluene such that the solid content concentration was 20 mass % to thereby prepare a first coating liquid for forming an elastic layer.

| | |
|---|---|
| Chloroprene rubber | 100 parts by mass |
| Carbon black | 40 parts by mass |
| Aluminum hydroxide | 30 parts by mass |
| Magnesium oxide | 5 parts by mass |
| Zinc oxide | 10 parts by mass |
| Titanium oxide | 10 parts by mass |
| Tin oxide | 15 parts by mass |

As the elastomer, chloroprene rubber (DCR-66; manufactured by Denka Company Limited) was used; as the conductive agent, carbon black (SPECIAL BLACK 4; manufactured by Degussa AG) was used; and as the metal oxide particles, aluminum hydroxide particles (particle diameter: 1 to 10 μm, B-303; manufactured by Tomoe Engineering Co., Ltd.), magnesium oxide particles (particle diameter: 1 to 10 μm, KYOWAMAG 30; manufactured by Kyowa Chemical Industry Co., Ltd., "KYOWAMAG" is a registered trademark of this company), zinc oxide particles (particle diameter: 0.5 to 5 μm, activated zinc white; manufactured by Hakusuitech Co., Ltd.), titanium oxide particles (particle diameter: 0.1 to 5 μm, SA-1 manufactured by Sakai Chemical Industry Co., Ltd.), and tin oxide particles (particle diameter: 1 to 5 μm, stannic oxide; manufactured by Nihon Kagaku Sangyo Co., Ltd.) were used.

Next, according to a method similar to the method of applying the coating liquid for forming a base layer to the outer circumferential surface of the mold, a first coating liquid was applied to an outer circumferential surface of the resin substrate to form a first liquid film of the first coating liquid on the outer circumferential surface of the resin substrate. Then, the resin substrate having the first liquid film formed on the outer circumferential surface thereof was rotated at 50 rpm about the cylindrical axis, while being heated at 50° C. for 1 hour using a far-infrared drying apparatus to thereby volatilize most of a solvent. Lastly, the resin substrate was introduced into a hot-air drying furnace, and heated at 170° C. for 20 minutes, whereby the chloroprene rubber was crosslinked to form an elastic layer having a thickness of 200 μm. The resin substrate having the elastic layer formed thereon was employed as "elastic layer belt." At that time, it was confirmed by SEM observation that the above-mentioned metal oxide particles having a particle diameter of about several micrometers were positioned on the surface of the elastic layer.

(Coupling Treatment)

3-Acryloxypropyltrimethoxysilane (KBM-5103; manufactured by Shin-Etsu Chemical Co., Ltd.) as the silane coupling agent was added to a pH 5.2 aqueous acetic acid solution such that the concentration was 10 mass %, and the mixture was stirred for 30 minutes to prepare a coupling treatment liquid.

Then, while the elastic layer belt was rotated at 50 rpm, the coupling treatment liquid was applied to the outer circumferential surface of the elastic layer using a brush, followed by heating at 80° C. for 15 minutes in a heating furnace. Thus, only a portion of a surface of the metal oxide particles which is positioned at the outer circumferential surface of the elastic layer was coupling-treated. The elastic layer belt having been coupling-treated is referred to as "coupling-treated elastic layer belt."

(Formation of Surface Layer)

The following components in the following amounts were dissolved and dispersed in propylene glycol monomethyl ether acetate (PMA) such that the solid content concentration was 10 mass %. Then, 1% by weight of a surface tension regulator (Silface SAG008; manufactured by Nissin Chemical Industry Co., Ltd., "Silface" is a registered trademark of this company) relative to the total amount of the dispersion liquid with the following components being dispersed was further added to thereby prepare a second coating liquid for forming a surface layer.

| | |
|---|---|
| Pentaerythritol triacrylate | 50 parts by mass |
| Polyurethane acrylate | 50 parts by mass |
| Polymerization initiator | 5 parts by mass |

As the radical polymerizable compound, pentaerythritol triacrylate (M-305; manufactured by Toagosei Co., Ltd.) and polyurethane acrylate (UV-3520TL; manufactured by The Nippon Synthetic Chemical Industry Co., Ltd.) were used; and as the polymerization initiator, 1-hydroxy-cyclohexyl-phenyl-ketone (IRGACURE 184; manufactured by BASF Japan Ltd.; "IRGACURE" is a registered trademark of this company) was used.

Next, while the coupling-treated elastic layer belt was rotated at 20 rpm, the second coating liquid was spray-applied to the outer circumferential surface of the coupling-treated elastic layer belt using a thin film spray applicator (manufactured by YD mechatro solutions Inc.) under the following spray-application conditions to form a second liquid film of the second coating liquid. Then, the coupling-treated elastic layer belt with the second liquid film being formed on the outer circumferential surface thereof was rotated at 20 rpm about the cylindrical axis, while being heated at 60° C. for 10 minutes using a far-infrared drying apparatus to thereby volatilize a solvent. Then, while the coupling-treated elastic layer belt was kept rotated, the second liquid film with the solvent being volatilized was irradiated with UV rays as actinic energy radiation under the following irradiation conditions to perform curing by a radical polymerization reaction, whereby a surface layer having a thickness of 2 μm was formed.

(Spray Application Conditions)

Nozzle scanning speed: 1 to 10 mm/sec

Distance from nozzle outlet to the surface of second liquid film: 100 to 150 mm

Number of nozzle: 1

Second coating liquid supply amount: 1 to 5 mL/min

Oxygen flow rate: 2 to 6 L/min (Irradiation Conditions)

Type of light source: High-pressure mercury lamp (H04-L41: Eye Graphics Co., Ltd.)

Distance from irradiation hole to the surface of second liquid film: 100 mm

Dose of irradiation light: 1 J/cm$^2$

Irradiation time: 240 seconds

Through the above-described steps, an endless belt-like intermediate transferrer 1 in which a base layer, an elastic layer and a surface layer are laminated sequentially was produced.

[Production of Intermediate Transferrers 2 to 7]

As shown in Table 1, intermediate transferrers 2 to 7 were produced similarly to intermediate transferrer 1, except that the type of the elastomer in the elastic layer as well as the metal oxide and the compounding amount of metal oxide particles were changed. In intermediate transferrers 2, 4, 5, and 7, as the metal oxide particles, silicon dioxide particles (particle diameter: 0.1 to 10 μm, REOLOSIL; manufactured by Tokuyama Corporation, "REOLOSIL" is a registered trademark of this company) were further used. Further, in intermediate transferrers 4 and 6, as the elastomer, nitrile butadiene rubber (Nipol DN631; manufactured by Zeon Corporation, "Nipol" is a registered trademark of this company) was used instead of chloroprene rubber.

Table 1 shows, for each intermediate transferrer, category, intermediate transferrer No., type of elastomer in elastic layer, metal oxide of metal oxide particles, compounding amount of each of metal oxide particles, and total compounding amount. In table 1, "CR" of the type of elastomer means chloroprene rubber, and "NBR" thereof means nitrile butadiene rubber. Further, "No." indicates intermediate transferrer No., and "MOP" indicates metal oxide particles.

TABLE 1

| | | | Compounding Amount of MOP [parts by mass] | | | | | | |
|---|---|---|---|---|---|---|---|---|---|
| Category | No. | Elastomer | $Al(OH)_3$ | ZnO | SnO | MgO | $TiO_2$ | $SiO_2$ | Total Compounding Amount |
| Ex. 1 | 1 | CR | 30 | 10 | 15 | 5 | 10 | — | 70 |
| Ex. 2 | 2 | CR | 30 | 10 | 15 | 5 | 10 | 30 | 100 |
| Ex. 3 | 3 | CR | — | 10 | 15 | 5 | — | — | 30 |
| Ex. 4 | 4 | NBR | 70 | — | — | — | 10 | 20 | 100 |
| Ex. 5 | 5 | CR | 70 | 10 | 15 | 5 | 10 | 40 | 150 |
| Ex. 6 | 6 | NBR | — | 5 | 10 | 5 | — | — | 20 |
| Ex. 7 | 7 | CR | 10 | — | — | — | 5 | 5 | 20 |
| Ex. 8 | 8 | CR | 30 | 10 | 15 | 5 | 5 | 5 | 70 |
| Comp. Ex. 1 | 9 | CR | 30 | 10 | 15 | 5 | 10 | — | 70 |
| Comp. Ex. 2 | 10 | CR | — | 5 | 5 | — | — | — | 10 |

[Production of Intermediate Transferrer 8]

Intermediate transferrer 8 was produced similarly to intermediate transferrer 1, except that metal oxide particles having been coupling-treated with a silane coupling agent in advance were used to form an elastic layer without performing the coupling treatment step after the formation of the elastic layer, and that the metal oxide and the compounding amount of metal oxide particles were changed as shown in Table 1.

[Production of Intermediate Transferrer 9]

Intermediate transferrer 9 was produced similarly to Example 1, except that the coupling treatment of metal oxide particles was not performed.

[Production of Intermediate Transferrer 10]

Intermediate transferrer 10 was obtained similarly to intermediate transferrer 1, except that the metal oxide and the compounding amount of metal oxide particles were changed as shown in Table 1.

[Evaluation]

(1) Peeling Test

The adhesive property of the surface layer of each intermediate transferrer was measured by a cross-cut method specified in JIS K5600. More specifically, first, eleven cuts reaching the elastic layer were formed on the surface layer of each intermediate transferrer in a manner spaced 1 mm apart from each other along directions orthogonal to each other to form 100 grids (10 pieces×10 pieces). Next, a cellophane tape was pressure-bonded to the grid portions sufficiently, and the cellophane tape was pulled to be peeled off in a stroke at an angle of 45° relative to the surface layer. Then, the percentage of the number of grids at which no peeling occurs (residual rate) was determined, and was evaluated according to the following criteria. When the residual rate is 80% or higher, there is no practical problem.

(Evaluation Criteria in Peeling Test)

A: Residual rate of 100%

B: Residual rate of 80% or higher to lower than 100%

C: Residual rate of 0% or higher to lower than 80%

(2) Taber Abrasion Test

The adhesive property of the surface layer of each intermediate transferrer was measured by an abrasion test method using a wear ring specified in JIS K7204. More specifically, a wear ring was brought into contact with the surface layer for 3 minutes under the conditions of a wear ring CS-10F, a revolution number of 50 rpm, and a load of 250 gf to make an evaluation according to the following criteria.

(Evaluation Criteria in Abrasion Test)

A: No peeling was observed

B: Peeling was partially observed

C: Entire peeling was observed

Table 2 shows, for each intermediate transferrer, category, type of elastomer in elastic layer, compounding amount of metal oxide particles, the state of coupling-treated metal oxide particles, and evaluation results of peeling test and abrasion test. In table 2, "1" indicating the state of coupling treatment means that only the portion of the surface of the metal oxide particles which is positioned at the surface of the elastic layer has been coupling-treated; "2" means that the entire surface of the metal oxide particles has been coupling-treated; and "-" means that no coupling treatment has been performed.

TABLE 2

| | Compounding | | | Peeling Test | | Abrasion |
|---|---|---|---|---|---|---|
| Category | Elastomer | Amount of MOP [parts by mass] | Coupling | Residual Rate [%] | Evaluation | Test |
| Ex. 1 | CR | 70 | 1 | 100 | A | A |
| Ex. 2 | CR | 100 | 1 | 100 | A | A |
| Ex. 3 | CR | 30 | 1 | 100 | A | A |
| Ex. 4 | NBR | 100 | 1 | 100 | A | A |
| Ex. 5 | CR | 150 | 1 | 100 | A | A |
| Ex. 6 | NBR | 20 | 1 | 90 | B | B |
| Ex. 7 | CR | 20 | 1 | 80 | B | B |
| Ex. 8 | CR | 70 | 2 | 80 | B | B |
| Comp. Ex. 1 | CR | 70 | — | 10 | C | C |
| Comp. Ex. 2 | CR | 10 | 1 | 0 | C | C |

As is obvious from Table 2, in all of intermediate transferrers 1 to 8 according to Examples 1 to 8, the adhesive property between the elastic layer and the surface layer was excellent. This is considered to be because at least the portion of the surface of the metal oxide particles which is positioned at the surface of the elastic layer has been coupling-treated by a metal coupling agent (a silane coupling agent, in the present embodiment) having a radical polymerizable functional group. The radical polymerizable functional group of the metal coupling agent can be bonded to a radical polymerizable compound via radical polymerization. It is considered that the elastic layer and the surface layer are firmly bonded together by chemical bonding via the metal coupling agent, whereby high adhesive property between the elastic layer and the surface layer is achieved.

In particular, in intermediate transferrers 1 to 5 according to Examples 1 to 5, the adhesive property between the elastic layer and the surface layer was excellent. This is considered to be because the content of the metal oxide particles in the elastic layer is 30 parts by mass or more relative to 100 parts by mass of the elastomer, meaning that sufficient amounts of metal oxide particles which contribute to the bonding between the elastic layer and the surface layer are contained.

Further, in intermediate transferrers 6 and 7 according to Examples 6 and 7, the content of the metal oxide particles in the elastic layer was less than 30 parts by mass, but intermediate transferrers 6 and 7 had an adhesive property between the elastic layer and the surface layer similar to that of intermediate transferrer 8 according to Example 8 in which the content of the metal oxide particles in the elastic layer was 30 parts by mass or more. It can be found, from this result, that it is preferable to allow only the portion of the surface of the metal oxide particles which is positioned at the surface of the elastic layer to be coupling-treated after the formation of the elastic layer, rather than to allow the metal oxide particles having been coupling-treated in advance to be contained in the elastic layer. This is considered to be because the coupling treatment after the formation of the elastic layer in the production steps of intermediate transferrers 6 and 7 makes it unnecessary to perform compounding steps (kneading step and dispersion step) of metal oxide particles and an elastomer, in which a metal coupling agent may leave the metal oxide particles.

On the other hand, in both intermediate transferrers 9 and 10 according to Comparative Examples 1 and 2, the adhesive property between the elastic layer and the surface layer was insufficient. This is considered to be because, for intermediate transferrer 9 according to Comparative Example 1, metal oxide particles in the elastic layer have not been coupling-treated; and, for intermediate transferrer 10 according to Comparative Example 2, the content of metal oxide particles in the elastic layer is insufficient.

INDUSTRIAL APPLICABILITY

According to the present invention, it is possible to provide an intermediate transferrer that can be produced easily without deteriorating a material and is excellent both in durability and the adhesive property between an elastic layer and a surface layer. In addition, according to the present invention, it is possible to provide an image forming apparatus capable of suppressing defective transfer, and of stably forming a high-quality image over a long period of time.

What is claimed is:

1. An intermediate transferrer comprising:

a base layer;

an elastic layer disposed on the base layer and composed of an elastomer composition containing an elastomer and metal oxide particles; and a surface layer disposed on the elastic layer and formed by curing a radical polymerizable compound via radical polymerization, wherein at least a portion of a surface of the metal oxide particles is positioned at a surface of the elastic layer, at least the portion is coupling-treated with a metal coupling agent having a radical polymerizable functional group, and the radical polymerizable functional group of the metal coupling agent is bonded to the radical polymerizable compound via radical polymerization.

2. The intermediate transferrer according to claim 1, wherein the elastomer has no hydroxyl group.

3. The intermediate transferrer according to claim 1, wherein only the portion of the surface of the metal oxide particles which is positioned at the surface of the elastic layer is coupling-treated with the metal coupling agent.

4. The intermediate transferrer according to claim 1, wherein a content of the metal oxide particles in the elastic layer is 30 parts by mass or more relative to 100 parts by mass of the elastomer.

5. The intermediate transferrer according to claim 1, wherein the metal coupling agent is a silane coupling agent.

6. The intermediate transferrer according to claim 1, wherein the radical polymerizable functional group is at least one member selected from the group consisting of a vinyl group, a styryl group, and a (meth)acryloyl group.

7. The intermediate transferrer according to claim 1, wherein a hardness of the elastomer composition as measured using a type A micro rubber durometer MD-1 is 60 to 80°.

8. The intermediate transferrer according to claim 1, wherein a volume resistivity of the elastomer composition is $1\times10^{8}$ to $1\times10^{11}$ Ω·cm.

9. The intermediate transferrer according to claim 1, wherein the elastomer composition has a flame retardancy of VTM-2 or higher in a flame retardancy test in UL 94 standard.

10. An image forming apparatus comprising at least an intermediate transferrer for transferring a toner image formed on a photoreceptor to a recording medium, wherein the intermediate transferrer is the intermediate transferrer according to claim 1.

* * * * *